US007267074B1

(12) United States Patent
Hicks

(10) Patent No.: US 7,267,074 B1
(45) Date of Patent: Sep. 11, 2007

(54) BI-FOLD DINGHY

(76) Inventor: Kenneth Hicks, 1475 Mallard Lake Ave., Fruit Cove, FL (US) 32259

( * ) Notice: Subject to any disclaimer, the term of this patent is extended or adjusted under 35 U.S.C. 154(b) by 0 days.

(21) Appl. No.: 11/653,608

(22) Filed: Jan. 16, 2007

(51) Int. Cl.
*B63B 7/04* (2006.01)

(52) U.S. Cl. ..... 114/353

(58) Field of Classification Search ..... 114/352, 114/353, 354
See application file for complete search history.

(56) References Cited

U.S. PATENT DOCUMENTS 2,157,186 A * 5/1939 Pinter, Sr. et al. ..... 114/344
3,090,973 A * 5/1963 Levinson ..... 114/344
3,932,906 A 1/1976 Johnson
4,063,659 A 12/1977 Welch
4,671,202 A * 6/1987 Johnson ..... 114/353
4,827,865 A * 5/1989 Yelderman ..... 114/353
5,183,002 A 2/1993 Parker
5,184,565 A 2/1993 Matthews
5,353,733 A * 10/1994 Evans ..... 114/353
5,372,085 A 12/1994 Kaye
5,524,570 A 6/1996 Kaye
5,868,097 A * 2/1999 Spickelmire ..... 114/353
5,957,080 A 9/1999 Ovard
6,240,872 B1 6/2001 Zhou
6,615,762 B1 9/2003 Scott
6,662,743 B1 * 12/2003 Rolfe ..... 114/344
6,729,260 B2 5/2004 Elvestad
6,948,443 B1 9/2005 Kopylov

* cited by examiner

*Primary Examiner*—Stephen Avila
(74) *Attorney, Agent, or Firm*—Lawrence J. Gibney, Jr.

(57) ABSTRACT

A bi-fold dinghy, which is foldable from front to back, is being claimed in this application. It will be easily stowed and transported on the back of a sailboat or other vessel like the traditional dinghy. It will allow individuals to get to and from the boat and ashore while also economizing space but having all the safety features of a dinghy.

8 Claims, 5 Drawing Sheets

BI-FOLD DINGHY

BACKGROUND OF THE INVENTION

A. Field of the Invention

This relates to a dinghy, which is a vessel that is commonly found on a larger vessel. Dinghies are used to transport people and cargo from a vessel that is anchored offshore such as a sailboat to the shore. Dinghies are commonly found on the back of sailboats.

B. Prior Art

There are many other prior art references to sailboats, sailboat accessories and dinghies. Some of them are foldable dinghies. However, they do not address the space concerns that are commonplace in every sailboat. The dinghy typically is stowed on the back of a sailboat but must not exceed the width or beam of the vessel for storage reasons.

Representative examples of dinghies in the prior art include Elvestad, U.S. Pat. No. 6,729,260, Scott, U.S. Pat. No. 6,615,762, Kaye, U.S. Pat. No. 6,240,872 and Kaye, U.S. Pat. No. 5,372,085.

Both the Kaye patents fold from side to side as opposed to front to back and therefore are patentably distinct. The other devices do not have the same features as the current application.

BRIEF SUMMARY OF THE INVENTION

This device is a bi-fold or foldable dinghy, which will be stored on the back of a sailboat in a folded state during normal transport. The advantage to folding the dinghy is to maximize space on a sailing or power vessel. A dinghy is typically used to transport people and cargo from a vessel, which is anchored in a body of water to the shore or land destination such as a dock or pier. Many different types of construction materials may be used with a dinghy but fiberglass is a popular choice.

The dinghy will have a bottom surface and a top surface. The bottom or hull surface will rest on the surface of the water when it is used and will be solid. The top surface will be open and will allow the transport of individuals and cargo while using the dinghy. The device will have a forward section and an aft (rear) section; the forward section will fold over the aft section during transport. The aft section is open and will allow the transport of persons as well as cargo, if needed. The forward section will house an anchor assembly, which is secured to the interior of the forward section and is hinged. A cover for the forward section is also provided.

It is contemplated that the dinghy will be stowed on the larger vessel with cables and ropes, which will attach to eyebolts on the outside surface of the dinghy; backing plates for the eyebolts will be used.

When the dinghy is to be used, it will be lowered into the water in the folded arrangement. A certain area of the dinghy will allow an individual to step on a part of the dinghy to allow access to the dinghy so that it may be unfolded. Because the dinghy will be exposed to water, non-skid surfaces will likely be used at predetermined areas of the dinghy.

The forward section will be tapered towards the front or bow of the dinghy, and several hinges will be placed between the forward and aft sections to allow the dinghy to be folded. The hinges will be located under the fiberglass and will be secured with a series of backing plates for added strength and rigidity. The installation of a backing plate does not interfere with the normal operation of the hinge mechanism.

In order to prevent water intrusion, a gunwale strip or raised lip on the top surface of the respective sections will be installed; the gunwale strips are offset from each other so that the front section can be folded over the rear section. When the dinghy is folded, the water will not be permitted to enter the first section because of the raised offset gunwale strips.

On the back of the aft section will be several storage areas and a place by which an individual can get on and off the device. Additionally an engine transom will be provided between the two storage sections on the aft section to secure a means of propulsion, probably a small gasoline engine. A drain hole will also be provided to drain any water from the space that is occupied by the transom and from the dinghy.

Between the forward and aft sections a series—at least three—of hinge mechanisms are installed that will allow the forward section to fold over the aft section. Backing plates are installed in the fiberglass for added strength but do not interfere with the operation of the respective hinge. Two of the hinges will lie flat against the forward and aft sections when the dinghy is unfolded and the hinge surfaces in the middle between the two sections will be essentially parallel to each other.

In the area where the dinghy sections will fold, a seat lock, which will firmly lock the front and rear bulkhead sections, will be provided. The seat lock will have a flat top surface and two members which extend a predetermined parallel distance and will cover both the forward and aft section bulkheads.

DETAILED DESCRIPTION OF THE EMBODIMENTS

Figure 1:
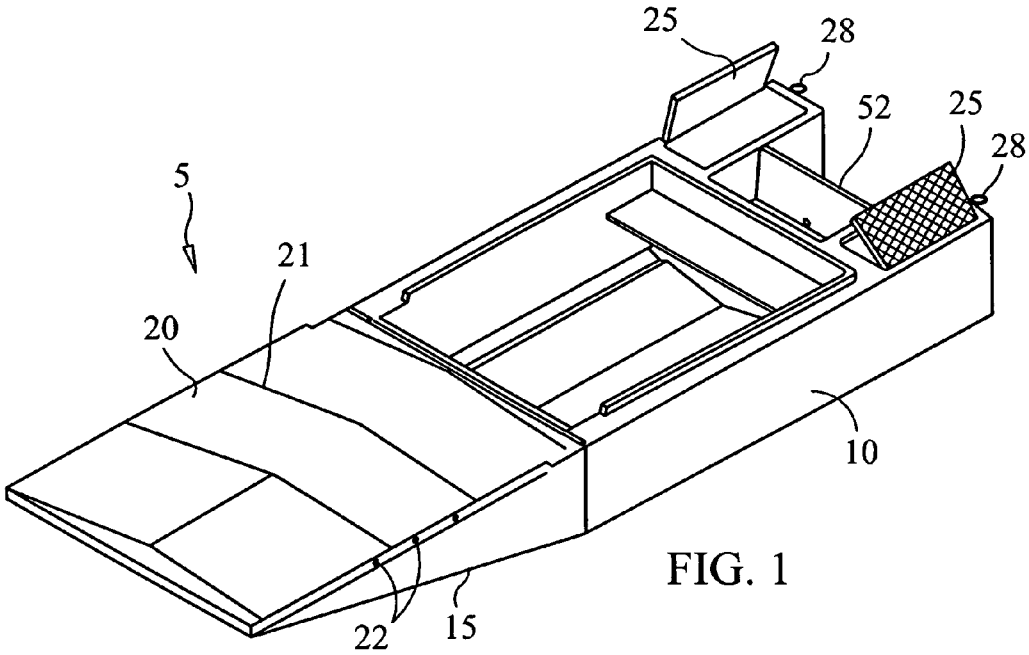
FIG. 1 is an isometric view of the dinghy fully deployed.
Figure 2:
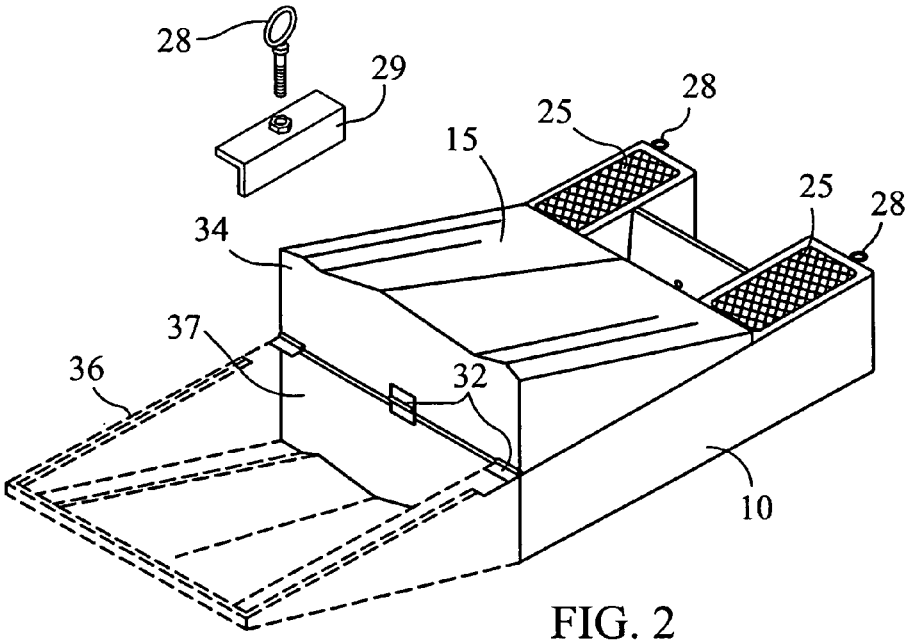
FIG. 2 is an isometric view of the dinghy in the stowed position.
Figure 3:
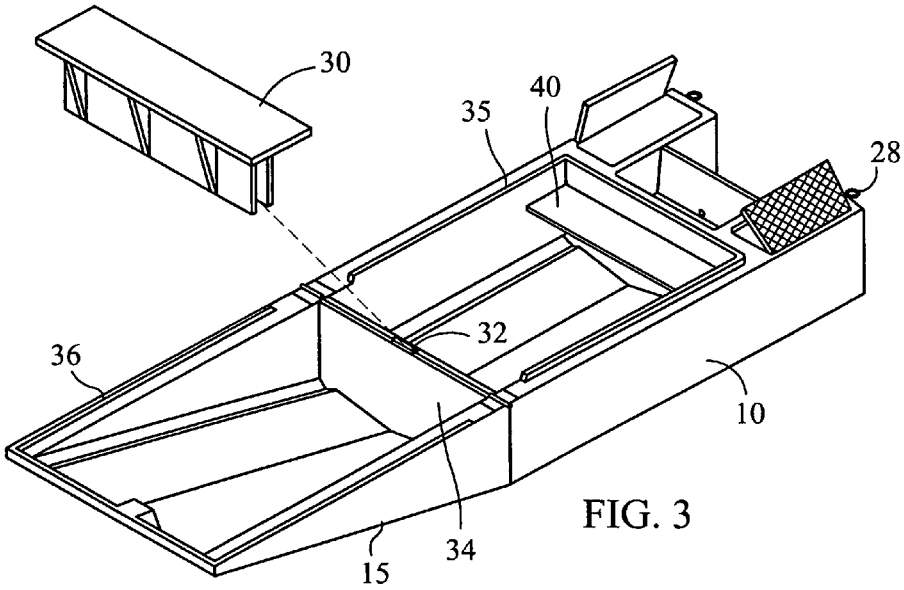
FIG. 3 is an isometric view of the dinghy with the seat lock.
Figure 4:
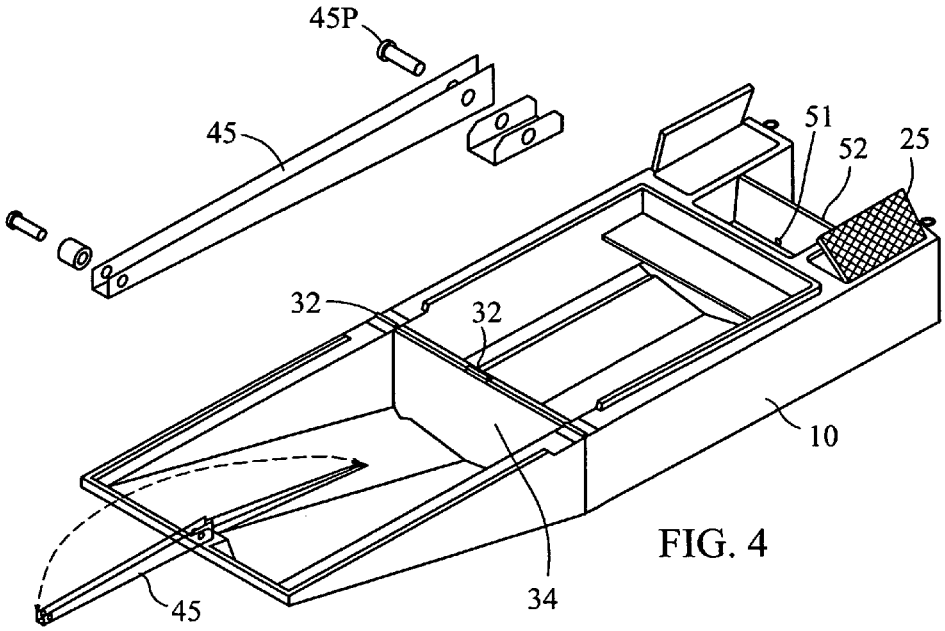
FIG. 4 is an isometric view of the dinghy with the boom arm.
Figure 5:
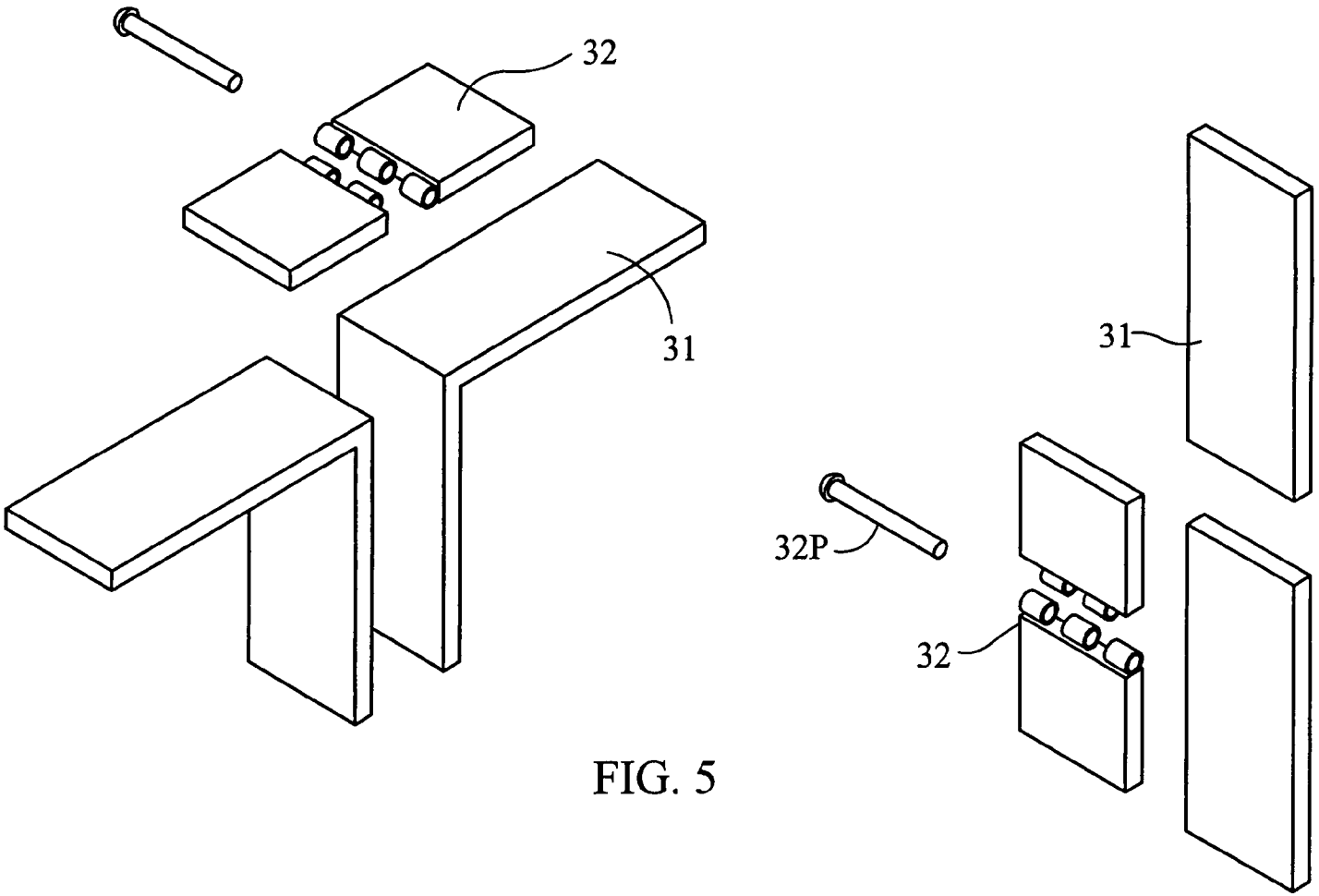
FIG. 5 is a view of the hinge mechanism with the backing plate.
Figure 6:
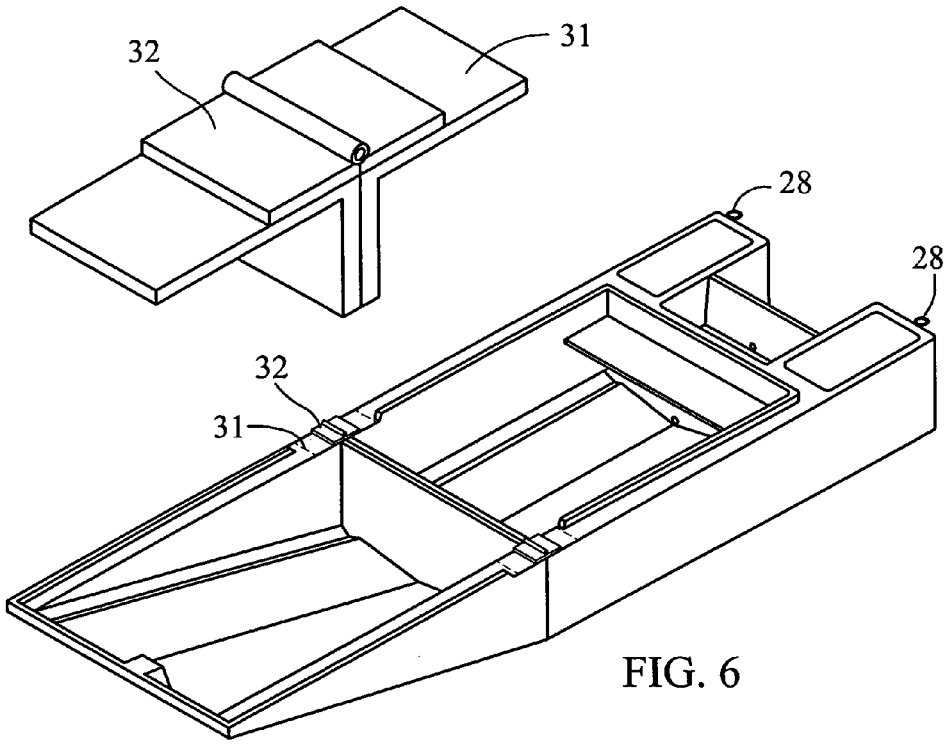
FIG. 6 is a view of the hinge mechanism and backing plate installed on the side of the dinghy.
Figure 7:
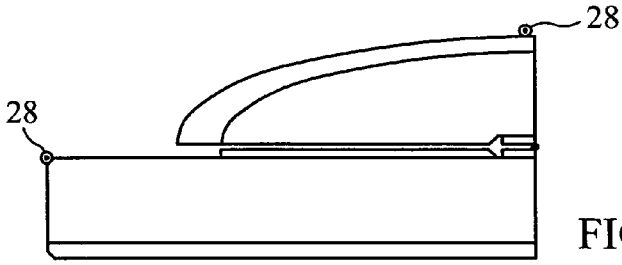
FIG. 7 is a side view of the dinghy in the folded position.
Figure 8:
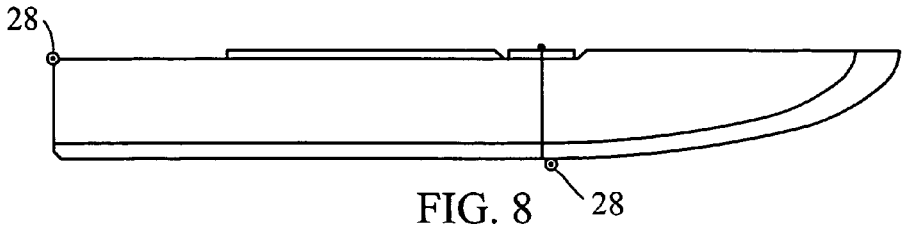
FIG. 8 is a side view of the dinghy unfolded.

| NUMBERING REFERENCE | |
|---|---|
| 5 | Dinghy |
| 10 | Aft section |
| 15 | Forward section |
| 20 | Canvas cover |
| 21 | Fiberglass battens |
| 22 | Snaps |
| 25 | Safety step |
| 28 | Eyebolts |
| 29 | Eyebolt backing plates |
| 30 | Seat Lock |
| 31 | Hinge backing plate |
| 32 | Hinge |
| 32P | Hinge Pin |
| 34 | Forward section bulkhead |

-continued

| NUMBERING REFERENCE | |
|---|---|
| 35 | Gunwale drip edge-aft section |
| 36 | Gunwale drip edge-forward section |
| 37 | Aft section aft bulkhead |
| 40 | Seat |
| 45 | Folding anchor roller arm |
| 45P | Folding anchor roller arm pin |
| 51 | Drain hole |
| 52 | Engine transom |

This device is a bi-fold or foldable dinghy 5. It will consist of a forward section 15 and an aft section 10. Both the forward 15 and aft sections 10 have a flat solid bottom surface and an open top surface. The front and rear sections are joined together using a set of hinges 32 on the top surfaces of both the forward and aft sections at the junction of the two sections. A portion of the forward section is hollow as well as a portion of the aft section to provide an interior cavity for storage purposes and the occupants of the dinghy.

A cover 20 for the forward section may also be provided to prevent water from entering the forward section. The cover 20 is likely to be secured using a series of snaps 22 along the perimeter of the forward section. Battens 21 that are installed in the cover will allow the cover 20 to keep a certain semi-rigid shape to prevent water from pooling on the cover when it is installed.

In the forward section an anchor roller arm 45 will be provided. The anchor roller arm 45 is hingedly secured to the inside of the forward section with a pin 45P and may be stowed under the cover 20 when not in use.

When the device is unfolded the forward section bulkhead 34 will be positioned parallel to the aft section bulkhead 37. The seat lock 30 will be inserted over the respective forward section and aft bulkheads to secure the relative positions of the bulkheads during normal use.

The seat lock 30 will extend from one side of the dinghy to the other and will extend to the bottom of the respective forward and aft section bulkheads. This seat lock 30 will prevent the separation of the forward and aft sections and also allow persons who are using the dinghy to sit during transit, if desired. In order to provide additional rigidity and stability in the device and particularly to reinforce the forward and aft sections where the dinghy folds, the seat lock 30 is provided.

The seat lock 30 is likely to be a flat planar surface with two vertical members attached to one side of the flat planar surface and extending downward a predetermined distance. The two vertical members will cover the respective forward and aft bulkheads and allow and provide stability so that the two sections remain unfolded during normal use.

On the rear of the device will be a set of safety steps 25, which will also be hollow and allow for storage of various items. The safety steps 25 will extend a predetermined distance from the rear of the device to allow an individual to place a foot while getting on and off the dinghy 5. A non-skid surface will be on the top of the safety step. An engine (not depicted) will be positioned in the space between the safety steps 25 and mounted to the engine transom 52. A drain 51 will also be provided.

In the aft section a rear seat 40 will be provided to allow individuals to sit during normal operation of the dinghy. The rear seat 40 will extend from one side of the interior of the aft section to the other and will be secured to the aft section. No specific means to secure the rear seat 40 is being claimed.

A means to lift and stow the device will also be provided and is likely to be a set of eye hooks or eye bolts 28 located on the side surfaces of the back of the dinghy and the underside of the device near the junction of the forward and aft sections. Backing plates 29 for the eyebolts, which are embedded in the material that is used to make the dinghy will also be provided to add strength. The eyebolts 28 will allow cables or ropes from the vessel to secure the dinghy 5 during transport.

In order to prevent water intrusion into the dinghy during normal transport, a gunwale strip on the forward 36 and a corresponding gunwale strip on the aft section 35 will be provided. The gunwale strips are raised strips, around a pre-determined portion of the perimeter of the respective sections which will prevent water from entering the dinghy during normal transport. The aft gunwale strip 35 is offset from the forward gunwale strip 36 to allow the forward section to be folded over the aft section. The aft gunwale strip 35 will be offset such that it is interior to the forward gunwale strip 36 when the two sections are folded.

Figure 9:
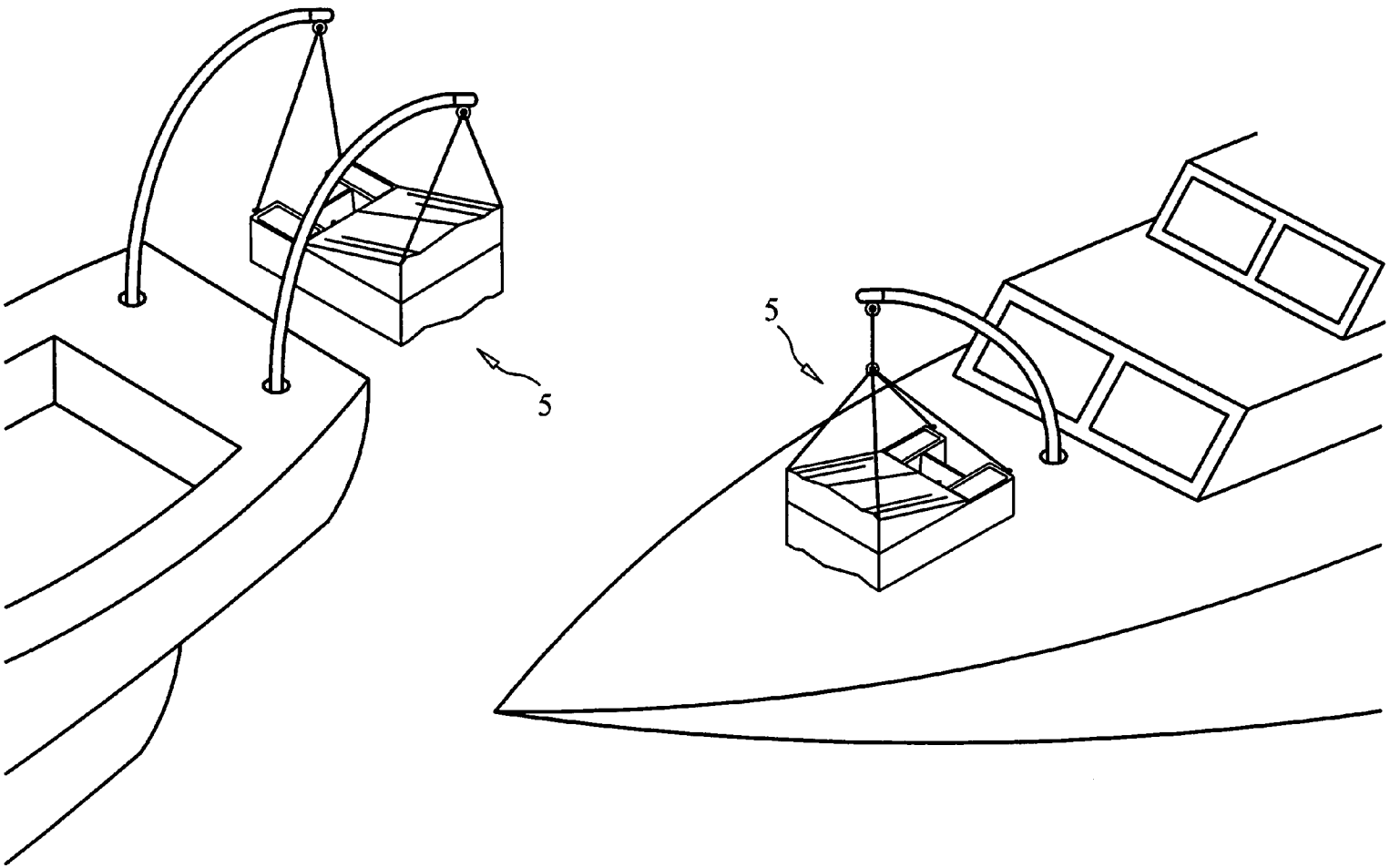
FIG. 9 is an isometric view of possible storage options.

The general purpose of the dinghy is to transport passengers from a sailboat or other vessel that is anchored to the shore. When the device is stowed, typically on the back of a sailboat or other vessel, it will be suspended by a set of cables that will pass through the eye bolts 28 on the rear section and the eyebolt on the front of the device when the device is folded such as depicted in FIG. 9.

The invention claimed is:

1. A foldable dinghy, which is comprised of:

a. a forward section;

wherein the forward section has a bottom surface and a top surface;

said bottom surface is solid;

said top surface is open;

wherein the forward section has a first end and a second end;

b. an aft section;

wherein the aft section has a bottom surface and a top surface;

said bottom surface is solid;

said top surface is open;

e. means of connection for the forward and aft sections;

wherein the forward and aft sections are connected together using a means of connection;

wherein the means of connection will allow the forward and aft sections to be folded against each other;

d. a seat lock;

said seat lock is comprised of a flat planar member and two vertical members that extend a predetermined length;

wherein the vertical members are spaced a predetermined distance from each other to allow the seat lock to fit over the forward and aft bulkheads;

e. safety step;

wherein a plurality of safety steps are provided on the aft section of the device;

wherein the safety steps allow individuals to get on and off the dinghy;

wherein a non-skid surface is placed on the top surface of the safety steps;

f. a seat;

wherein a seat is provided in the aft section of the device;

wherein the seat extends from one side to the other of the hollow cavity of the aft section;

wherein the seat allows the occupants of the dinghy to sit during normal operation of the dinghy;

g. gunwale strips;

wherein a gunwale strip is provided on the top surface of the forward section;

wherein a corresponding gunwale strip is provided on the top surface of the aft section;

said gunwale strips are offset;

wherein when the device is folded, the gunwale strips provide a water barrier between the sections;

h. a means to transport;

wherein a means to transport is provided.

2. The device as described in claim 1 wherein the means to transport is a plurality of eye bolts.

3. The device as described in claim 1 wherein the seat lock is further comprised of a flat planar member and two vertical members extending a predetermined distance downward;

wherein the vertical members are spaced a predetermined distance apart from each other;

said distance is greater than the width of the members at the junction of the forward and aft sections.

4. The device as described in claim 1 wherein the means of connection for the forward section and aft sections is a plurality of hinges.

5. The device as described in claim 4 wherein the means of connection are reinforced with a plurality of backing plates.

6. The device as described in claim 1 wherein the forward section gunwale strips and aft section gunwale strips are offset from each other.

7. The device as described in claim 1 wherein a cover is provided for the forward section.

8. The cover as described in claim 7 wherein a means to secure the cover to the forward section is provided.

* * * * *